United States Patent [19]

Horne et al.

[11] Patent Number: 5,005,307

[45] Date of Patent: Apr. 9, 1991

[54] CARTRIDGE MONITORING AND DISPLAY SYSTEM FOR A FIREARM

[76] Inventors: John N. Horne, 2274-B 47th St.; Michael A. Wolf, 3195 Arizona, both of Los Alamos, N. Mex. 87544

[21] Appl. No.: 458,582

[22] Filed: Dec. 29, 1989

[51] Int. Cl.[5] ..... F41A 9/62

[52] U.S. Cl. ..... 42/1.02

[58] Field of Search ..... 42/1.01, 1.02, 1.03

[56] References Cited

U.S. PATENT DOCUMENTS 3,552,053 1/1971 Jarvis ..... 42/1.02

FOREIGN PATENT DOCUMENTS 2182424 5/1987 United Kingdom ..... 42/1.02

*Primary Examiner*—Charles T. Jordan

*Assistant Examiner*—Richard W. Wendtland

*Attorney, Agent, or Firm*—William A. Eklund

[57] ABSTRACT

A cartridge monitoring and display system for an automatic or semiautomatic firearm. A programmed microcontroller receives input signals form each of a slide switch and a magazine switch, which switches generate respective signals upon actuation of the firearm slide and upon insertion or withdrawal of a cartridge magazine. The microcontroller calculates the number of rounds remaining in the firearm and displays the number on an LCD display. A visible and audible warning is given when the cartridge count drops below a predetermined minimal level. The entire system is incorporated in a mounting strap which may be inserted between the frame and a hand grip of a conventional semiautomatic pistol.

11 Claims, 7 Drawing Sheets

CARTRIDGE MONITORING AND DISPLAY SYSTEM FOR A FIREARM

BACKGROUND OF THE INVENTION

1. Field of the Invention.

The invention described and claimed herein is generally related to firearms having integrally contained systems for monitoring and displaying the supply of ammunition in the firearm, such as a semiautomatic or automatic pistol or rifle.

2. Description Of Related Art

Automatic and semiautomatic firearms do not contain any means for indicating the number of rounds of ammunition contained in the firearm. As a result, a well recognized problem in both competitive and combat shooting situations is the inability of the firearm user to be confidently certain at all times of the number of rounds of ammunition remaining in his firearm, particularly after some ammunition has been expended.

A user will typically know the maximum cartridge capacity of his firearm, and thus will usually know the number of rounds that the firearm initially contains upon loading. Thus, the initial cartridge count is not ordinarily a problem.

After firing the firearm, however, the user will typically be far less certain of the number of rounds remaining. With automatic weapons the user will only have a general idea of the number of rounds remaining after a burst of rounds has been fired from the firearm. Only through experience can a user even estimate how many rounds might be left after firing a burst, and even then such an estimate is only approximate. Nevertheless, in both competitive and combat shooting it is critical that a shooter not overestimate the amount of ammunition remaining in his firearm, and thereby run out of ammunition at a critical moment when it may be necessary to fire. At the same time, tactical considerations dictate that a shooter should make optimum use of his firearm, by using as much ammunition as possible before each reloading. These competing considerations make it desirable for the user to know exactly how much ammunition remains in his firearm at all times.

Even with a semiautomatic weapon, where each cartridge is individually fired by the user, it is frequently difficult to be certain of the number of cartridges remaining. If the semiautomatic weapon contains only a limited number of cartridges, for example a semiautomatic pistol, the user may be able to mentally keep track of the number of cartridges fired, and thereby calculate the number of cartridges remaining. However, during the stress of a combat situation or a competitive shooting event a user will frequently be unable to keep track of the number of cartridges that have been fired and thus will not be certain of the number of cartridges remaining in the firearm, even in the case of pistol having a capacity of only a few rounds.

This lack of certainty, as to the supply of ammunition remaining in the firearm, is a primary limitation on the user's ability to assess and respond to tactical situations where snap decisions must be made whether to shoot, reload, or take other appropriate tactical actions.

SUMMARY OF THE INVENTION

Accordingly, it is the object and purpose of the present invention to provide a firearm having an integrally contained system for monitoring and visually displaying the number of rounds of ammunition contained in the firearm.

It is also an object and purpose of the present invention to provide a device for monitoring and displaying the number of cartridges contained in a semiautomatic or automatic firearm, particularly a semiautomatic pistol.

It is another object and purpose of the present invention to attain the foregoing objects in a system which automatically accommodates reloading of the firearm, and which also alerts the user when the supply of ammunition in the firearm has been expended to a predetermined low level.

The foregoing objects and purposes are attained in the present invention, which provides a system for monitoring and visually displaying the supply of ammunition in a semiautomatic or automatic firearm having a frame and a slide means. The slide means may be the conventional slide of a semiautomatic pistol, or it may be, for example, the bolt or bolt carrier of an automatic or semiautomatic rifle. In general, the present invention is applicable to any firearm which is loaded by means of a cartridge magazine and which has a slide element which slides relative to the frame upon firing of the firearm. The cartridge monitoring and display system of the present invention includes a slide switch which is operable to produce a slide signal upon sliding of the slide to the frame; a magazine switch affixed to the frame which is operable to generate a magazine signal upon insertion or withdrawal of a magazine from the firearm; a programmed control circuit which is operable to receive the slide and magazine signals; and a visual display unit affixed to the firearm. In operation control circuit operates to receive the slide and magazine signals and produce on the visual display unit a readout of the number of cartridges in the firearm.

In a preferred embodiment the slide switch, the magazine switch, the programmed control circuit and the visual display unit are all integrally contained in a mounting strap which is readily insertable between the frame and the hand grip of a conventional firearm.

It should be understood that although the present invention will be described herein with reference to a semiautomatic pistol, the invention will be also applicable to and useful in any automatic or semiautomatic firearm in which there is a slide element that moves rearwardly with respect to the firearm frame upon firing of the firearm.

The present invention has useful application in the law enforcement community, possibly also in the military, and perhaps most significantly, in the short term, among competitive combat shooting enthusiasts.

These and other aspects of the present invention will be more apparent upon consideration of the following detailed description of the invention, when taken with the accompanying drawings.

BRIEF DESCRIPTION OF THE DRAWINGS

The Figures set forth in the accompanying drawings form a part of this specification and are hereby incorporated by reference. In the Figures.

These Figures, taken with the following detailed description of a preferred embodiment of the invention, are intended to illustrate to one of ordinary skill in the art how to make and use an embodiment of the present invention.

DESCRIPTION OF THE PREFERRED EMBODIMENT

Figure 1:
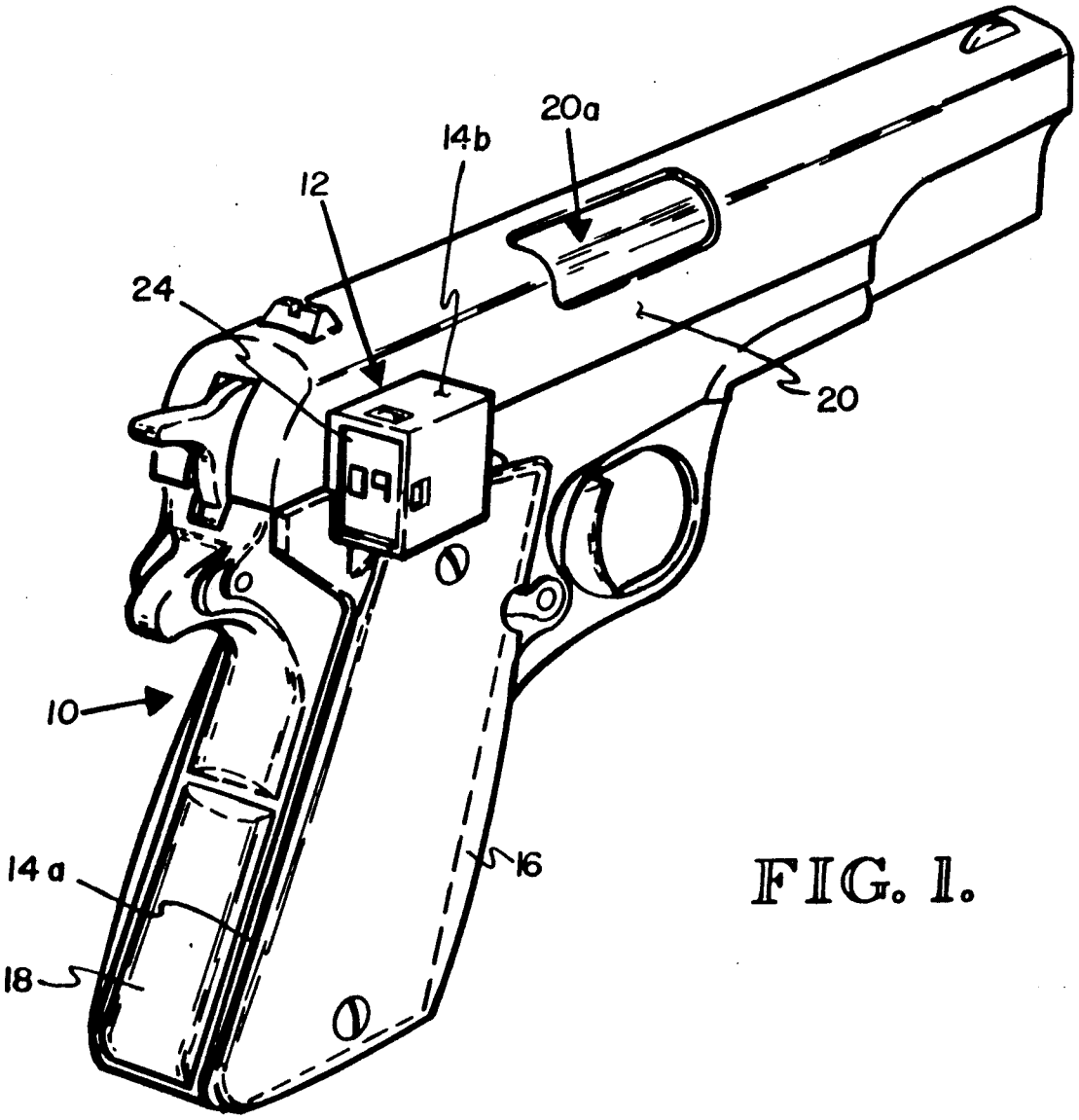
FIG. 1 is an isometric view of a semiautomatic pistol provided with a preferred embodiment of the cartridge monitoring system of the present invention, which is integrally contained within a mounting strap that is enclosed between the frame and handgrip of the pistol.

Referring to FIG. 1, there is illustrated a preferred embodiment of a semiautomatic pistol 10 equipped with a cartridge monitor and display system 12 provided in accordance with the present invention.

Figure 2:
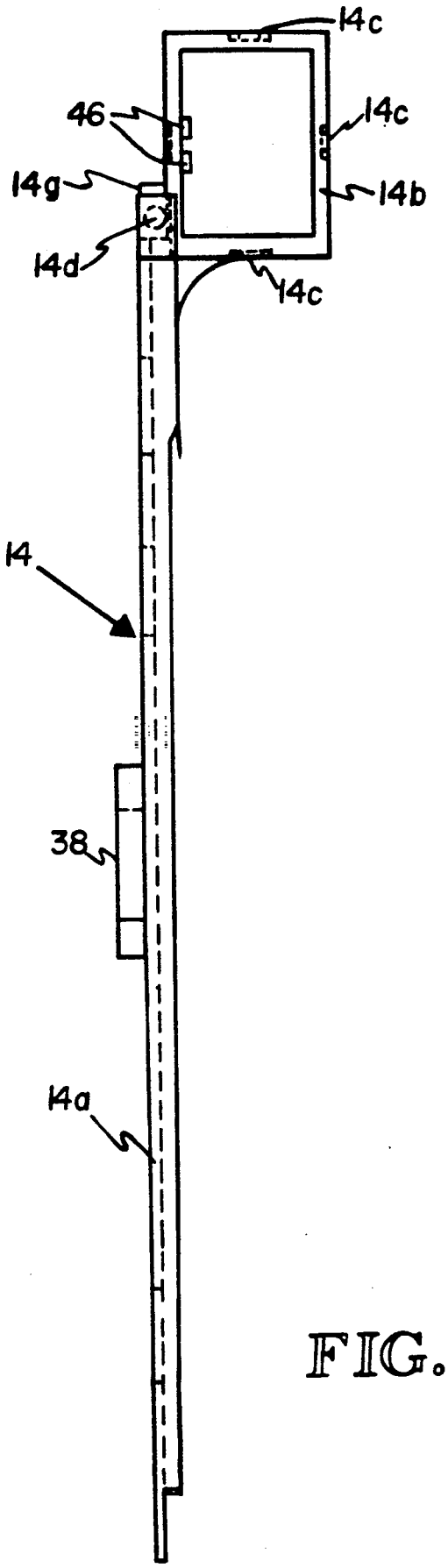
FIG. 2 is an end view of the mounting strap of the cartridge monitor fitted to the pistol shown in FIG. 1.
Figure 3:
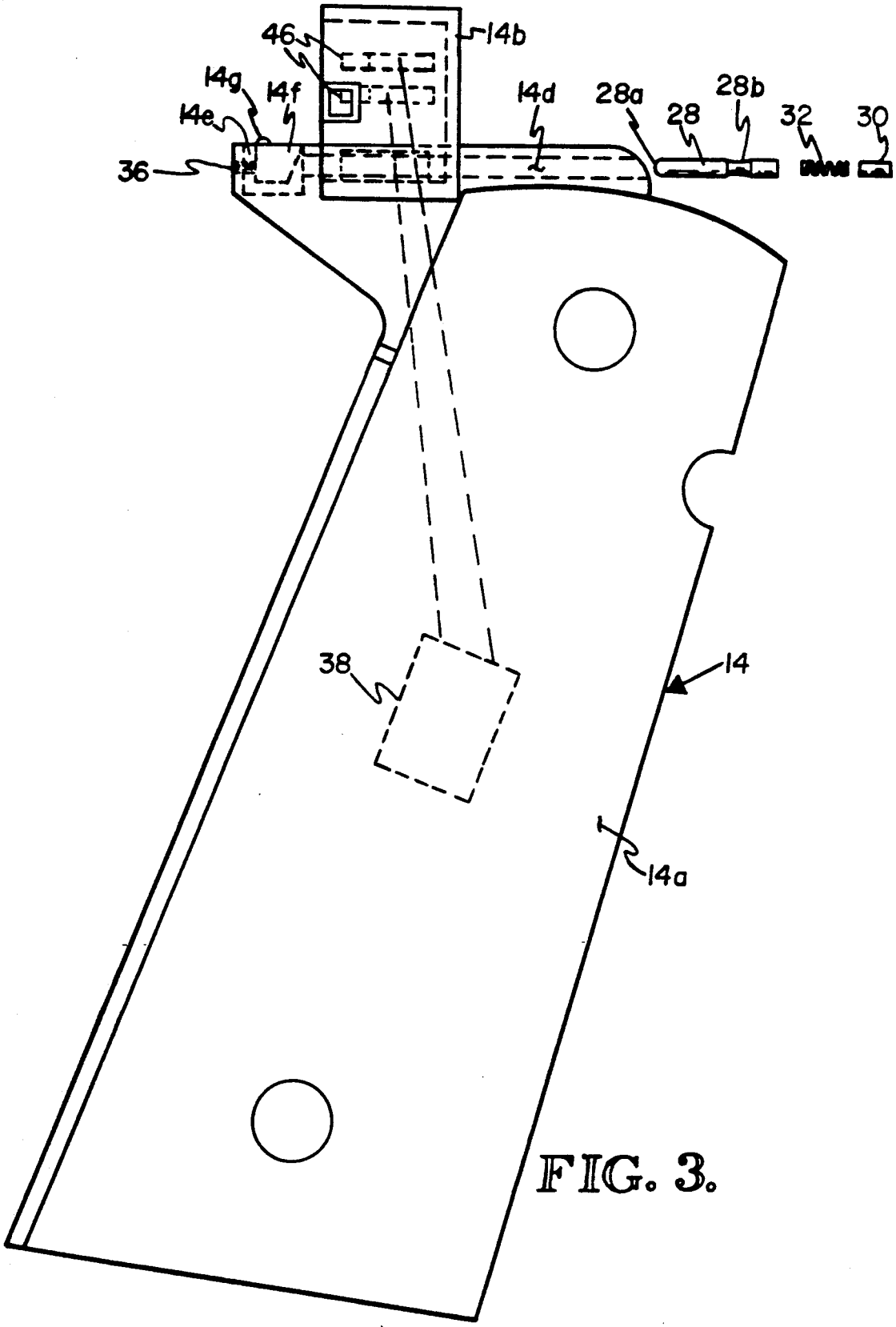
FIG. 3 is a side view of the mounting strap of FIG. 2, with other mechanical components shown in exploded view.
Figure 4:
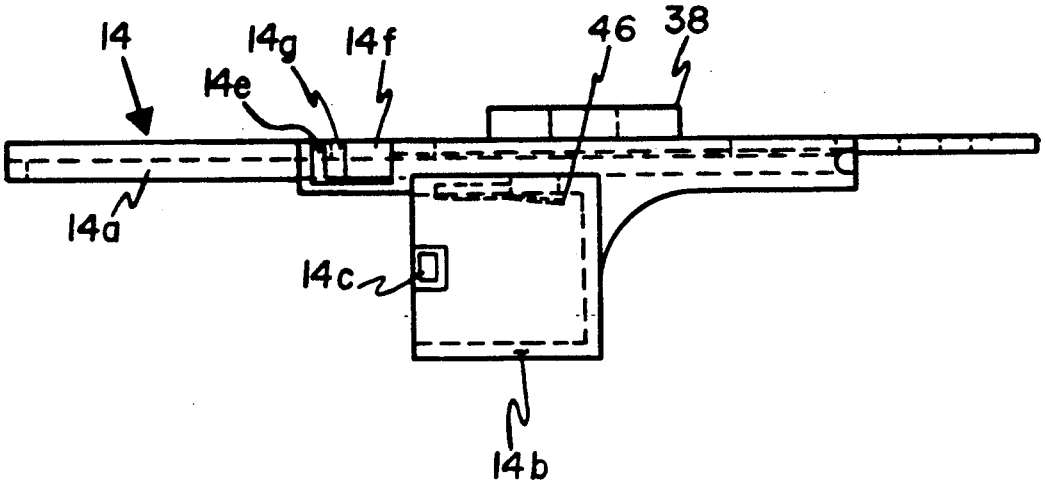
FIG. 4 is a plan view of the mounting strap of FIG. 2.

Briefly, the cartridge monitor and display system 12 includes a polymeric strap 14 which includes a flat lower portion 14*a* and an integral rectangular housing 14*b* at its upper end, shown also in FIGS. 2 through 4. The lower portion 14*a* of the strap 14 is thin and flat, and is enclosed between the conventional right-hand grip 16 and frame 18 of the pistol 10. The lower portion 14*a* of the strap 14 is sufficiently thin that it can be interposed between the frame 18 and grip 16 without substantially affecting the feel or performance of the pistol 10.

As noted above, the integral housing 14*b* extends from the upper end of the strap 14, and is positioned adjacent the rear end of the slide 20 of the pistol 10. The housing 14*b* opens rearwardly and contains an electronics module 22 (not shown in FIG. 1; described further below with reference to FIGS. 8 through 11). The electronics module 22 includes a liquid crystal display (LCD) unit 24, which also faces rearwardly. As described in detail below, the LCD unit 24 displays the number of cartridges contained in the pistol 10.

The electronics module 22, responding to input signals from a pair of switch sensors described below, monitors the firing of cartridges from the pistol 10. After each shot the electronics module 22 calculates the number of cartridges remaining in the pistol 10 and displays the number on the LCD 24, as described further below.

Referring particularly to FIGS. 2 through 4, the mounting strap 14 and its associated integral housing 14*b* are formed of an injection molded polymer material, preferably an acetal polymer. The lower portion 14*a* of the mounting strap 14 is thin and flat and is generally in the outline of the conventional hand grip 16 of the automatic pistol 10, with however the incorporation of the hollow housing 14*b* integrally attached at the upper end of the mounting strap 14.

Figure 5:
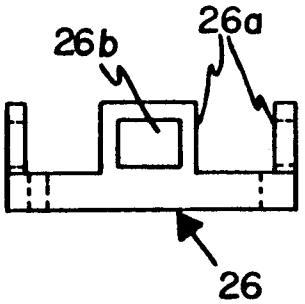
FIG. 5 is a plan view of a bezel for retaining an electronic module in the housing of the mounting strap.
Figure 7:
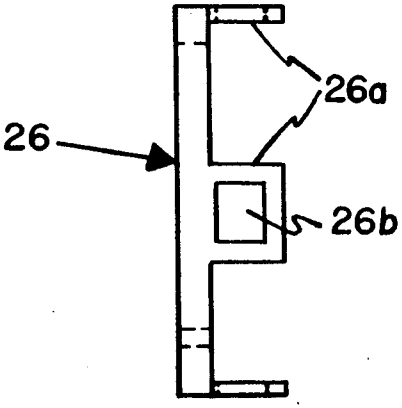
FIG. 7 is a side view of the bezel of FIG. 5.
Figure 6:
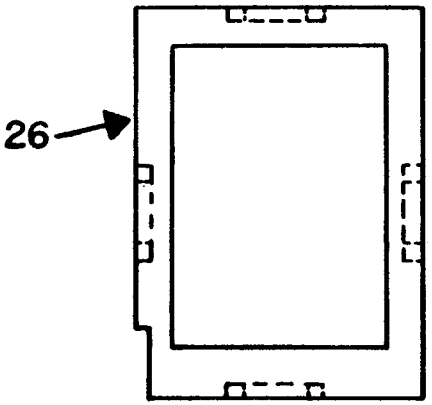
FIG. 6 is a front view of the bezel of FIG. 5.

The four outer surfaces of the housing 14*b* include four recesses 14*c* which are positioned adjacent to and centered on the open rear end of the housing 14*b*, each recess 14*c* having a ramped protrusion extending from its base. The protrusions in the recesses 14*c* function to retain a rectangular frame bezel 26. The bezel 26, shown in FIGS. 5 through 7, includes four integral retaining ears 26*a*, each with a rectangular hole 26*b*. The retaining ears 26*a* snap into position over the ramped protrusions in the recesses 14*c* of the housing 14*b*, so as to retain the electronic module 22 inside the housing 14*b*.

The mounting strap 14 further includes a bore 14*d*, which extends alongside the base of the housing 14*b*. The bore 14*d* opens at its rear end into an upwardly opening recess 14*e* which is integrally formed at the rear, upper end of the mounting strap 14. A stainless steel plunger 28 is contained in the bore 14*d*. The plunger 28 includes a rounded rear end 28*a*, and a detent 28*b* in its midsection. The bore 14*d* closed at its forward end by means of an acetal plug 30 which is adhesively secured in place. A coil spring 32 is positioned between the plug 30 and the plunger 28. The spring 32 urges the plunger 28 toward the recess 14*e*. The plunger 28, spring 32 and plug 30 are shown in exploded view in FIG. 3.

The upwardly opening recess 14*e* contains an integral actuator hinge 14*f*, which in turn includes an integral, upwardly protruding cam 14*g*. The actuator hinge 14*f* is integrally attached to, and is part of, the mounting strap 14. The hinge 14*f* is attached to the body of the strap 14 by means of an integral strip of acetal polymer, which is in the nature of a living hinge, as that term is known in the plastics industry; that is, it is an integral part of the strap 14 and swings on a small strip of polymeric acetal that extends from the body of the strap 14.

As noted above, the pistol 10 includes generally a slide 20 and a frame 18, with the strap 14 being captured between the frame 18 and the conventional grip 16. Upon each firing of the pistol, the slide 20 slides rearwardly on the frame 18 and then returns, with a spent cartridge shell being ejected through the conventional ejector opening 20*a* in the slide 20, and a new cartridge being loaded into the chamber of the pistol 10 from the magazine (not shown). The slide 20, frame 18, magazine and other major mechanical components of the pistol are conventional in design and operation.

As the slide 20 moves rearwardly, it engages the actuator cam 14*g* and depresses it downwardly, causing the actuator hinge 14*f* to be depressed downwardly as well. Downward depression of the actuator hinge 14*f* in turn causes the hinge 14*f* to drive the plunger 28 forward within the bore 14*d*. Forward motion of the plunger 28 in the bore 14*d* causes the detent 28*b* of the plunger 28 to displace a plunger of a slide switch 34, which extends from the electronic module 22 through a hole in the wall of the housing 14*b*, and which in the normal rest position rests in the detent 28*b* of the plunger 28. Actuation of the slide switch 34 results in a generation of a slide signal to the programmed electronic control circuitry described below. In its normal rest position, the rear end of the plunger 28 urges against the angled face of the actuator hinge 14*f*. A set screw 36 prevents the hinge 14*f* from being driven upwardly by the plunger 28.

A magazine switch 38 is located on the inside of the mounting strap 14. The magazine switch 38 is a pressure sensitive switch which extends through an opening of the pistol frame 18 so as to be in contact with a magazine in the pistol. The magazine switch 38 is closed each time a magazine is inserted in the pistol, transmitting a signal through a pair of wires embedded in the inside surface of the strap 14, to the electronics module 22 in the housing 14b.

Figure 8:
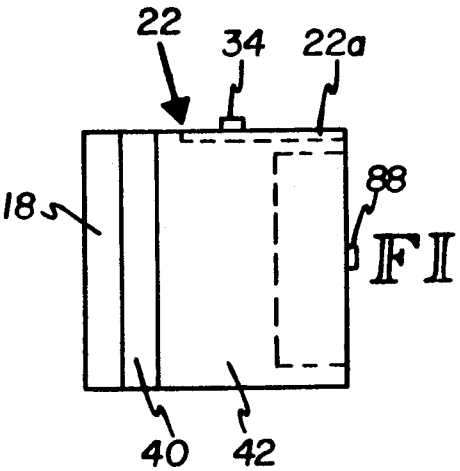
FIG. 8 is a plan view of the electronic module of the cartridge monitoring system.
Figure 9:
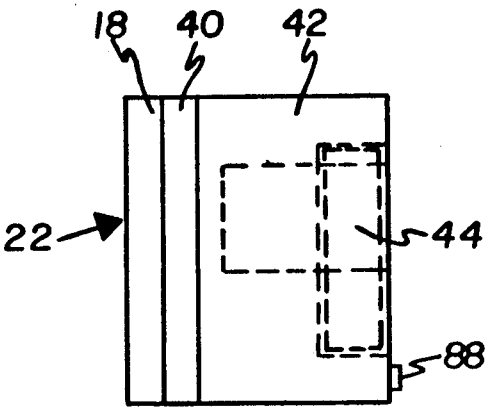
FIG. 9 is a side view of the electronic module of FIG. 8.
Figure 10:
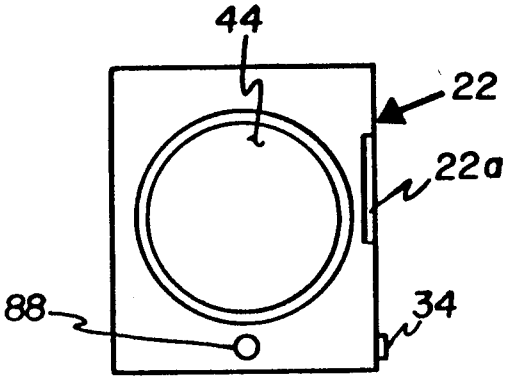
FIG. 10 is an end view of the electronic module of FIG. 8.

Referring to FIGS. 8 through 10, the electronics module 22 includes the LCD display unit 24, a tritium back light plate 40, an epoxy-embedded electronic circuit 42, and a battery 44. A pair of leaf spring electrical contacts 46 (FIG. 2) extend from the inside wall of the housing 14b and operate to connect the electronics module to the embedded leads from the magazine switch 38. The entire module 22 is generally cubic in shape, so that it may be inserted into the housing 14b and retained by the bezel 26. A small recess 22a on the inside wall of the module 22 accommodates the leaf spring contacts 46, and contains electrical leads connecting the spring contacts 46 to the electronic control circuit described below.

Figure 11:
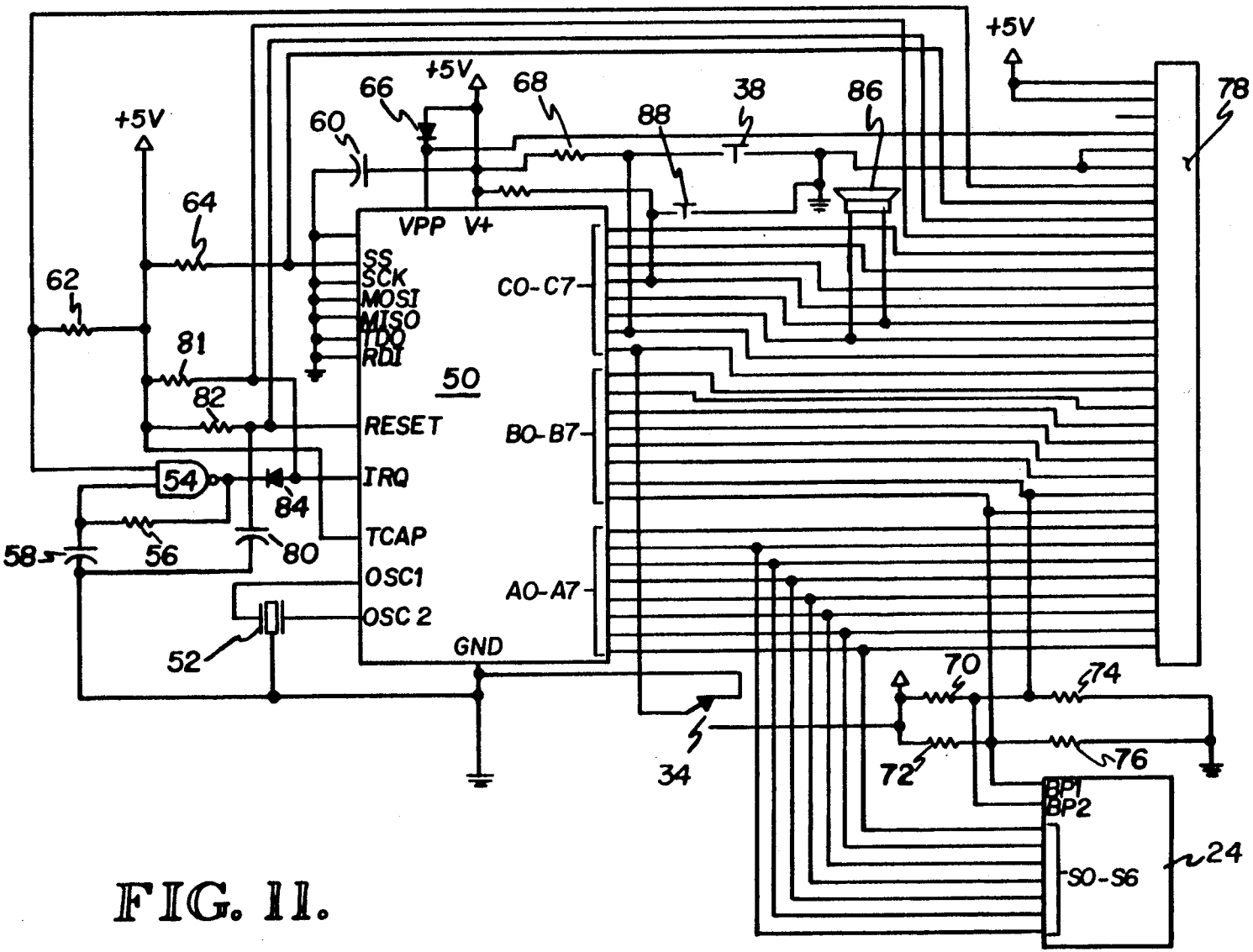
FIG. 11 is a schematic diagram of the electronic programmed control circuit contained in the electronic module.

The epoxy embedded control circuit 42 is illustrated schematically in FIG. 11. Referring to FIG. 11, the circuit 42 may include a Motorola MC68HC805C4 programmable microcontroller 50, which is loaded with a program that effects the functions described below. The microcontroller 50 may alternatively consist of a masked read only memory (ROM) which can be made and programmed to function in a manner identical to that described below for the MC68HC805C4 microcontroller 50, and which can be packaged more compactly than the programmable microcontroller 50. However, for the purpose of describing the function and operation of the invention, the following description will be directed to the MC68HC805C4 microcontroller 50.

The microcontroller 50 drives the liquid crystal display unit 24 through input ports S0 through S6 and BP1 and BP2 of the LCD 24. The LCD 24 is a two-digit, seven segment, multiplexed LCD, which is commercially available from a number of sources. The microcontroller 50, in addition to driving the LCD, also senses the states of the two input switches, the slide switch 34 and the magazine switch 38. As noted above, the slide switch 34 is closed each time the slide 20 slides back on the frame 18. The magazine switch 38 is closed each time a magazine is inserted into the pistol.

The oscillator terminals OSC1 and OSC2 of the microcontroller 50 are connected to a 200 Khz crystal 52, which sets the clock speed of the microcontroller 50. A Schmidt trigger AND gate 54, together with a one megohm resistor 56 and a 0.01 microfarad capacitor 58, are configured to constitute a 50 microsecond oscillator, and are connected to the interrupt input IRQ of the microcontroller 50, so as to generate an interrupt signal every 50 microseconds. This 50 microsecond period is the main cycle period for the microcontroller 50. Each time an interrupt signal is generated the microcontroller 50 refreshes the LCD display 24 and reads the status of the slide and magazine switches 34 and 38. The microcontroller 50 includes an internal timer, which is not used in this circuit and which is deactivated by applying a high logic signal to the TCAP input terminal of the microcontroller. The TCMP terminal is the output for the internal timer, and also is not used in this application.

The slide and magazine switches 34 and 38 are connected to the C0 and C4 parallel input ports, respectively, of the microcontroller 50.

A 0.1 microfarad ceramic capacitor 60 functions as a high frequency bypass for the power supply. Resistors 62 and 64 are part of the programming network, as well as diode 66. A 100 K resistor 68 serves to produce a pull-up signal on the magazine switch line.

The slide switch 34 operates slightly differently. It is a two position, single pole, double throw switch, one of position of which is ground and the other of which is connected to power supply voltage (3 volts).

Four one megohm resistors 70, 72, 74 and 76 are used to establish three-level signals which are necessary to drive the LCD backplane through terminals BP1 and BP2 of the LCD 24. In this regard, the LCD 24 has two backplanes, one for each of the two digits of the LCD. In operation, the two backplanes are alternately activated, at a frequency which is high enough that they both appear black to an observer, and the appropriate logic signals are applied to the digit segment inputs S0 through S6. The backplane signals require three different states, represented by the power supply voltage, an intermediate voltage generated by the resistors 70 through 76, and a ground signal.

The microcontroller 50 is connectable to a programming board by means of a programming connector 78, which is the means by which a control program is loaded into the microcontroller 50. As noted above, this element may be preferably omitted from the electronic module if a masked ROM is used to perform the functions described herein.

The special function input/output ports (D0 through D7) of the microcontroller 50 are ports to internal resources of the microcontroller which are not used in this application. For example there are serial input/output ports RDI and TDO. The MISO (master in slave out), MOSI (master out slave in) and SCK are ports ordinarily used to add extra peripherals to the microcontroller.

The VPP terminal of the microcontroller 50 is the input for the programming voltage, which is higher (20 volts) than the ordinary power supply voltage. The V+ terminal is the power supply input to the microcontroller 50. The eight-bit A, B and C ports are general purpose parallel I/O ports. The A0 through A6 ports are used for the digit segment signals to the LCD terminals S0 to S6. Output ports B0 and B1 are used for the backplane lines. C0 and C1 are used as inputs from the slide and magazine switches 32 and 36, respectively.

The A, B and C parallel I/0 ports are also used for programming purposes. The microcontroller 50 is equippted with a programmable EEPROM which is loaded with the program desired to be loaded into the microcontroller.

A 0.1 microfarad capacitor 80 and a 100 kilohm resistor 82 are connected to the RESET terminal of the microcontroller 50 so as to generate a reset signal upon power-up of the circuit, for example each time a new battery is installed. A 20 kilohm pullup resistor 81 is interposed between the interrupt input IRQ and the +5 volt supply. A diode 84 is interposed between the interrupt generator subcircuit and the interrupt terminal IRQ for programming purposes.

In operation, the microcontroller 50 is programmed such that, when a battery is first inserted, it initializes itself. It sets the number of cartridges in the firearm to zero, as the battery is normally installed with the gun unloaded. Upon receipt of the first interrupt signal, the microcontroller 50 refreshes the LCD to zero, and then reads the two switches 32 and 36. If the switches are both in their normal, open, states, the microcontroller 50 does nothing and awaits the next interrupt signal, with the LCD continuing to display 0.

Upon insertion of a magazine, ordinarily containing for example 8 cartridges, into the pistol, the magazine switch 38 is closed as the magazine is inserted. Upon detecting that the magazine switch 38 is closed, the microcontroller 50 sets the number of cartridges to eight and displays this number on the LCD 24.

When the slide 20 slides rearwardly on the frame 18, either upon firing of the pistol or upon manual retraction of the slide 20, the slide switch 34 is closed momentarily. This closure is detected by the microcontroller 50, which in response decrements the count of cartridges by one, and displays the result on the LCD unit 24. This is done each time the pistol is fired or the slide is manually retracted, either of which will eject a cartridge.

Upon firing of the last round in the magazine, or the eighth round in the example just given, the slide 20 is arrested in a rearward position on the frame 18 and the slide switch 34 is held in the closed position. The microcontroller 50 identifies that it has counted to zero, corresponding to unloaded pistol with no round in the chamber.

When all but one cartridge has been expended, i.e., the cartridge count is reduced to one, the microcontroller 50 is programmed to cause the LCD to flash repeatedly with the digit one, and also causes an audio generator 86, which is connected to I/O ports C2 and C3, to produce an audible sound, serving to warn the user that only one cartridge is left.

If the magazine is removed from the pistol before all cartridges have been expended, for example to reload with a full magazine at a particularly convenient time, it will be appreciated that a cartridge will ordinarily remain in the chamber of the pistol. Consequently, upon subsequent insertion of a magazine, which is assumed to be loaded with eight cartridges, the microcontroller 50 sets the count to nine and causes this to be displayed on the LCD. In this regard, the microcontroller 50 is programmed to set the cartridge count to the magazine capacity, plus one, when the the magazine switch 38 is closed while the slide switch 34 is open. This is in contrast to the situation where the slide 20 is arrested in the rearward position, upon expending all cartridges, in which situation the cartridge count is decremented to zero until a magazine is inserted into the pistol.

The microcontroller 50 can also be selectively programmed in the field to accommodate magazines of different capacities, as well as to turn the audio indicator on or off. This is done by manually closing a SET switch 88, which is located on the back of the electronics module 22, and which activated by pressing the face of the LCD 24. The microcontroller 50 is programmed to respond to such a signal by going into a SET mode. In the SET mode, the LCD 24 initially displays a single flashing digit in the most-significant-digit position. This digit can be changed to any number between 0 and 9 by closing the slide switch 34, by pulling the slide 20 back slightly by hand. When this is done with the microcontroller 50 in the SET mode, the slide switch 34advances by one the digit shown on the LCD 16. By then pressing the SET switch again, the second most significant digit is displayed and flashed, and this digit can then be changed to any number from 0 to 9 by manually retracting the slide up to nine times. In this manner, LCD can be changed to any desired number between 0 and 99, with the microcontroller subsequently using this number as the number of cartridges assumed to be in each magazine. Also, by pressing the SET switch 88 one more time, and subsequently retracting the slide 20 once, the audio indicator 86 can be toggled on or off. By pressing the SET switch 88 a fourth time, the microcontroller returns to the run mode and is ready for operation.

It will be appreciated that the preferred embodiment of the present invention described above can be incorporated into a conventional semiautomatic pistol with no modification or alteration of the ordinary components of the pistol. This is a significant advantage, in that no tooling, machining or other mechanical modification of the pistol is necessary to install and use the cartridge monitoring system.

The present invention has been described and illustrated with reference to a preferred embodiment. Nevertheless, it will be understood that various modifications, alterations and substitutions may be apparent to one of ordinary skill in the art, and that such modifications, alterations and substitutions may be made without departing from the essential invention. Accordingly, the present invention is defined only by the following claims.

The embodiments of the invention in which patent protection is claimed are:

1. In a semiautomatic or automatic firearm having a slide means which slides relative to a frame upon firing of the firearm, and wherein said firearm is loaded by magazine means inserted into said frame of said firearm and from which cartridges are fed into the firearm, a cartridge monitoring and display system comprising;

slide switch means affixed to said frame, said slide switch means including a cam means engaged by said slide means upon sliding of said slide means relative to said frame, said slide switch means being operable to produce a slide signal upon sliding of said slide means relative to said frame;

magazine switch means affixed to said frame, said magazine switch means being operable to generate a magazine signal upon insertion and withdrawal of a magazine from said firearm;

a programmed control circuit operable to receive said slide and magazine signals;

a visual display unit affixed to said frame and driven by said control circuit; and wherein said programmed control circuit operates to receive said slide and magazine signals, and to produce on said visual display unit a visual display of the number of cartridges contained in the firearm.

2. The cartridge monitoring and display system defined in claim 1 wherein said slide switch means, said magazine switch means, said programmed control circuit and said visual display unit are all incorporated in a mounting strap which is attachable to said frame.

3. The cartridge monitoring and display system defined in claim 2 wherein said mounting strap includes a thin integral lower portion which is mounted between said frame and a hand grip.

4. The cartridge monitoring and display system defined in claim 3 wherein said programmed control circuit and said visual display unit are contained in an integral housing formed in and extending from an upper end of said mounting strap.

5. The cartridge monitoring and display system defined in claim 1 wherein said programmed control circuit includes means for selectively setting the number of cartridges contained in each magazine.

6. The cartridge monitoring and display system defined in claim 4 wherein said slide switch means includes cam means which is engaged by said slide means upon sliding of said slide means relative to said frame.

7. The cartridge monitoring and display system defined in claim 6 wherein said mounting strap includes a longitudinal bore containing a plunger, and wherein said cam means includes an actuator hinge with associated actuator cam which are engaged by said slide means so as to actuate said slide switch means.

8. The cartridge monitoring and display system defined in claim 7 wherein said actuator hinge and said cam means are integrally formed with said mounting strap and include a living hinge.

9. A cartridge monitoring and display system for an automatic or semiautomatic firearm having a slide means and a frame, which firearm is fed by means of a cartridge magazine, comprising:

magazine switch means affixed to said frame and operable to generate a magazine signal upon insertion or withdrawal of a magazine from said firearm;

slide switch means affixed to said frame, said slide switch means including a cam means engaged by said slide means upon sliding of said slide means relative to said frame, said slide switch means being operable to produce a slide signal upon sliding of said slide means relative to said frame;

a programmed control circuit operable to receive said slide and magazine signals;

visual display unit affixed to said frame and driven by said control circuit; and wherein said programmed control circuit operates to receive said slide and magazine signals and to produce on said visual display unit an indication of the number of cartridges in the firearm.

10. The cartridge monitoring and display system defined in claim 9 wherein said slide switch means, said magazine switch means, said programmed control circuit and said visual display unit are all affixed to a mounting strap which is insertable between said frame and a hand grip of said firearm.

11. The cartridge monitoring and display system defined in claim 10 said programmed control circuit and said visual display unit are contained in an integral housing formed in said mounting strap.

* * * * *